United States Patent [19]

Pereira et al.

[11] 4,187,900

[45] Feb. 12, 1980

[54] REGENERATORS

[75] Inventors: Joseph K. Pereira; Martin White, both of Kingston-upon-Thames, England

[73] Assignee: British Steel Corporation, London, England

[21] Appl. No.: 845,670

[22] Filed: Oct. 26, 1977

[51] Int. Cl.[2] ..... F28D 19/04

[52] U.S. Cl. ..... 165/8; 165/10

[58] Field of Search ..... 165/8, 10

[56] References Cited

U.S. PATENT DOCUMENTS

| | | | |
|---|---|---|---|
| 3,216,486 | 11/1965 | Hall et al. | 165/8 |
| 3,391,727 | 7/1968 | Topouzian | 165/10 X |
| 3,777,804 | 12/1973 | McCoy | 165/8 |

FOREIGN PATENT DOCUMENTS 355674 8/1931 United Kingdom .

*Primary Examiner*—Albert W. Davis, Jr.
*Attorney, Agent, or Firm*—Bacon & Thomas

[57] ABSTRACT

A heat exchanger of the regenerative type comprising a matrix of heat storage elements and a support structure therefor comprising a plurality of support bars and a support rim upon which the bars are located; at at least one end each element of the matrix comprising a heat storage block having a plurality of gas flow passages extending therethrough from end to end of the block and being adapted to co-operate with at least one of the support bars for locating and supporting the blocks with respect to the rim in parallel generally side-by-side relation with one another.

12 Claims, 6 Drawing Figures

REGENERATORS

BACKGROUND OF THE INVENTION

This invention relates to a heat exchanger of the regenerative type wherein outgoing hot gases pass along a plurality of gas flow passages within a matrix, the heat stored therein being utilised to heat in-coming cool gases.

One regenerative heat exchanger of this type is that known as a rotary regenerator wherein the matrix is in the overall form of a disc mounted for rotation in such manner that each of its end faces passes continuously between hot and cold gas flow passages. At the actual end faces of the matrix there are provided sealing means to maintain separate on the one end face, for example, incoming hot gas and outgoing heated air, and on the opposed end face, incoming cold air and outgoing cooled waste gas.

One application of such a rotary regenerative form of heat exchanger has been in the recovery of heat from waste gases for use in air heating duties. Known forms of such heat exchangers having such an application include a disc matrix comprising a plurality of metallic or ceramic heat storage elements carried in metallic cages or baskets which totally enclose the elements and onto which the gas and air interface seals locate and operate. In such a construction the maximum operating temperature of the heat exchanger depends upon the structural integrity of the metallic cage at high gas temperatures and also upon the ability of the sealing system to cope with thermal distortions of the cage. In practice, cost considerations have limited the choice of metals for cage fabrication, and with existing plant the limit for hot gas temperature has been of the order of 1000° C.

In our co-pending British patent application 47199/74 filed Oct. 31, 1974, there is described a sealing system capable of obviating some of the sealing problem which can occur during distortion of the metallic cage and/or the metallic or ceramic heat storage elements.

SUMMARY OF THE INVENTION

It is an object of the present invention to provide a heat exchanger of the regenerative type having a new or improved structure of heat storage elements and support therefor.

In accordance with the invention there is provided a heat exchanger of the regenerative type comprising a matrix of heat storage elments and a support structure therefor comprising a plurality of support bars and a support rim or frame member upon which the bars are located; at at least one end each element of the matrix comprising a heat storage block having a plurality of gas flow passages extending therethrough from end to end of the block and being adapted to co-operate with at least one of the support bars for locating and supporting the blocks with respect to the rim in parallel generally side-by-side relation with one another.

Conveniently each heat storage block is of substantially right-angled parallelopipedal form having an external groove adjacent one end for co-operation with one or more of the support bars. Those blocks adjacent the rim are conveniently shaped to co-operate with the rim and with one or more of the support bars, whilst those blocks remote from the rim are conveniently provided with two external grooves, one in each of two opposite sides of the block, for co-operation with two respective support bars.

The heat storage blocks are conveniently urged into firm abutting contact with one another by biasing means acting inwardly on the blocks at the periphery of the matrix. Such biasing means may comprise a plurality of spaced fluid pressure actuated rams, or resilient packing means located around the peripheral blocks of the matrix. Such resilient packing may be compressed by mechanical means such as for example circumferential strapping.

The heat exchanger conveniently comprises a rotary heat exchanger wherein the matrix is of overall cylindrical disc-like configuration located on an annular rim and being driven for rotation by means of a gear drive to the exterior of the rim.

BRIEF DESCRIPTION OF THE DRAWINGS

Other features of the invention will become apparent from the following description given herein solely by way of example with reference to the accompanying drawings wherein.

DESCRIPTION OF THE PREFERRED EMBODIMENT

Figure 1:
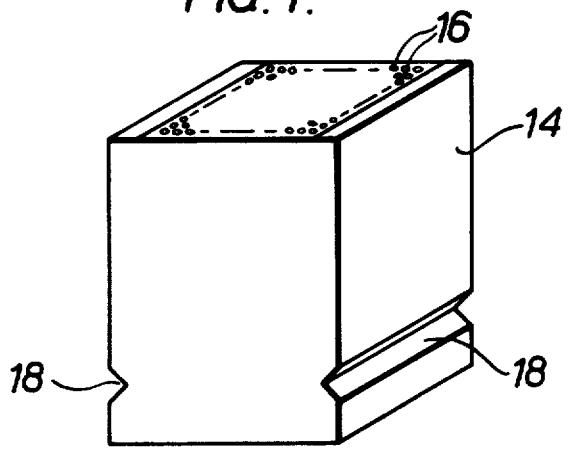
FIG. 1 is a diagrammatic perspective view of one of the heat storage blocks of the matrix for use in a rotary regenerative type of heat exchanger.
Figure 2:
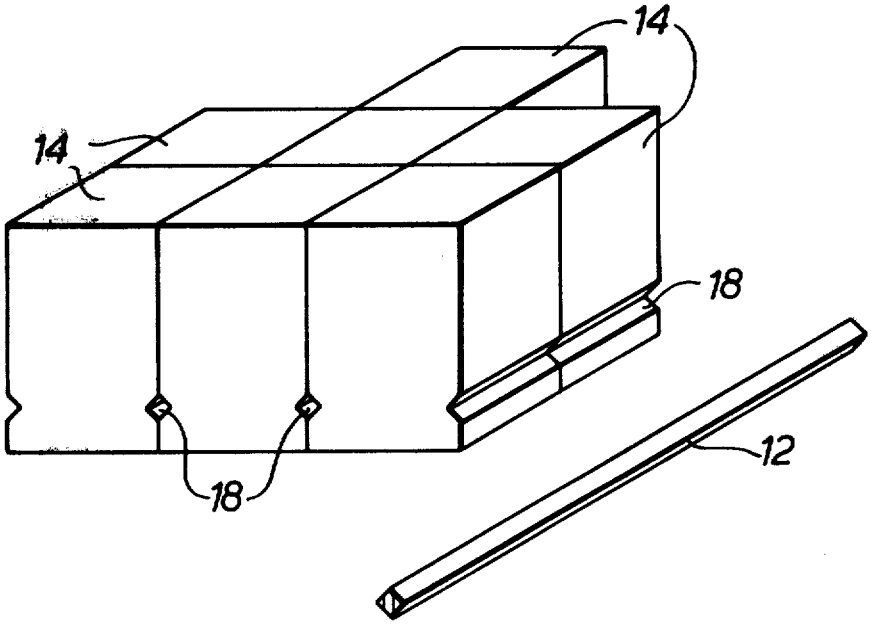
FIG. 2 is a diagrammatic perspective view of part of the assembled matrix and support bars.

Referring to FIGS. 1 to 4 of the drawings there is shown a rotary heat exchanger of the regenerative type which in use would be mounted for rotation about a vertical axis having an upper "hot" face for an incoming stream of hot gas and an outgoing stream of preheated air and a lower "cold" face for an outgoing steam of cooled waste gas and an incoming stream of cold air. The regenerator includes a frame member or metallic annular rim 10 carrying thereon, as illustrated, three parallel metallic support bars 12 upon which are mounted a plurality of heat storage elements in the form of ceramic blocks 14 each of which has a plurality of gas flow passages 16 extending therethrough from end to end, i.e., from the "hot" face to the "cold" face of the regenerator.

The heat storage blocks 14 when assembled, form a cylindrical disc-like matrix of ceramic elements carried on the frame member or rim 10 and supported and located by the support bars 12 which are themselves carried directly on the frame member or rim 10. As will be seen from the drawings each of the blocks 14 is of substantially rectangular cross-sectional form and is provided with one or more external grooves 18 adjacent its lower or "cold" face for co-operation with one or more support bars 12. The interior blocks **14*a* have flat rectangular sides while the exterior blocks 14*b* each have rectangular sides and one arcuate side which forms an arc of a circle. The exterior blocks 14b cooperate to provide the matrix with a circular periphery when the blocks are arranged with the interior blocks 14a surrounded by the exterior blocks and with the arcuate sides juxtaposed. The whole assembly is mounted in a horizontal plane and driven rotatably about a vertical axis by a drive mechanism (e.g. gear) acting on the exterior of the frame member or rim 10. The gas and air ducts are connected to headers 20-22-24-26 which direct the two streams to flow through separate segments of the matrix. The upper headers 20–22 respectively direct incoming hot waste gas onto, and outgoing preheated air away from, the upper "hot" face of the matrix whilst the lower headers 24–26 respectively direct outgoing cooled waste gas away from, and incoming cold air onto, the lower "cold" face. A suitable sealing system is provided between the headers and the respective end faces of the matrix. By arranging for the two streams to flow in countercurrent, with the hot gas flow axially downwards a relatively cold region may be obtained at the lower end of the matrix. It is in this "cold" region that the metallic support bars 12 are situated and it has been found that even for high grade heat recovery duties, wherein the hot gas inlet temperature may be as high as 1300° C., suitable dimensioning of the heat storage blocks 14 will product adequate cooling at the lower end of the matrix to permit non-specialised metals to be used for the support bars 12**.

As illustrated, the support bars 12 are of square cross-sectional form for engagement with V grooves 18 formed in the external surfaces of the heat storage blocks 14. The support bars 12 form a simple parallel bar grid in the plane of the matrix on an axial level near the lower "cold" end thereof and it is found that the choice of a V groove formation ensures that the crushing load at the bar/block inteface is spread over a large area and also that stress concentration problems in the load bearing region are minimised.

Figure 3:
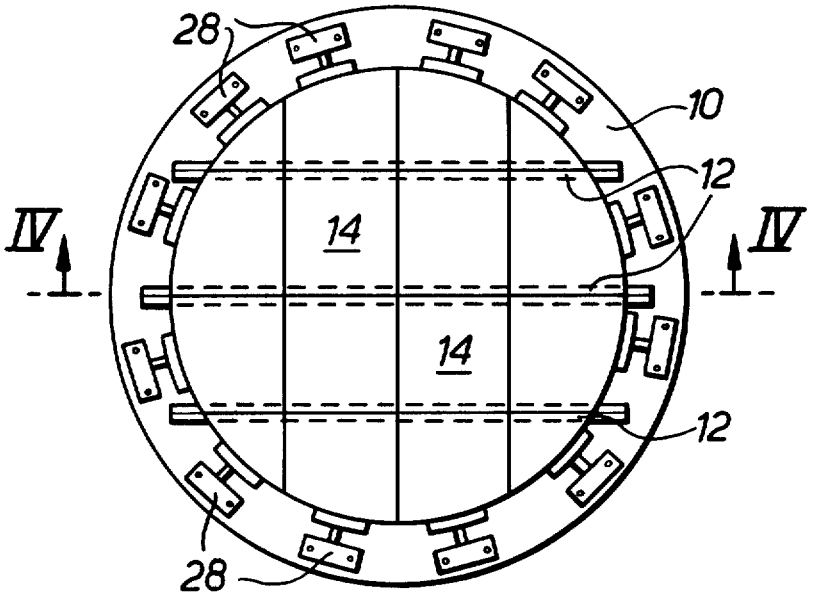
FIG. 3 is a diagrammatic plan view of the assembled matrix of heat storage blocks with radial compaction rams on the rim in one embodiment of the heat exchanger.
Figure 4:
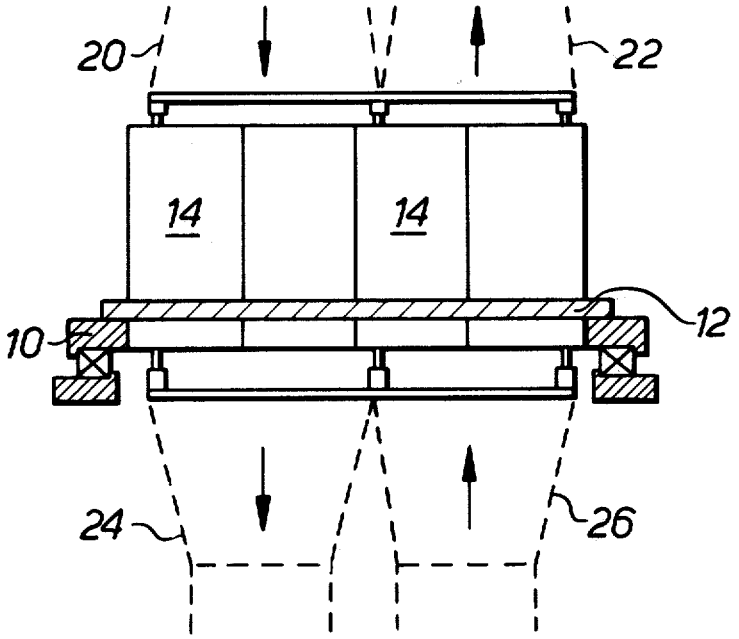
FIG. 4 is a side cross-sectional view on the line IV—IV of FIG. 3.

In the case of matrices with diameter to axial width ratios of less than 8 the simple parallel bar grid system of FIGS. 3 and 4 may be supported on the annular rim structure and the entire block assembly compacted either by fluid pressure actuated rams 28 spaced around the periphery of the matrix or by a mechanical resilient packing system. gement with V grooves 18 formed in the external surfaces of the heat storage blocks 14. The support bars 12 form a simple parallel bar grid in the plane of the matrix on an axial level near the lower "cold" end thereof and it is found that the choice of a V groove formation ensures that the crushing load at the bar/block inteface is spread over a large area and also that stress concentration problems in the load bearing region are minimised.

In the case of matrices with diameter to axial width ratios of less than 8 the simple parallel bar grid system of FIGS. 3 and 4 may be supported on the annular rim structure and the entire block assembly compacted either by fluid pressure actuated rams 28 spaced around the periphery of the matrix or by a mechanical resilient packing system.

Figure 5:
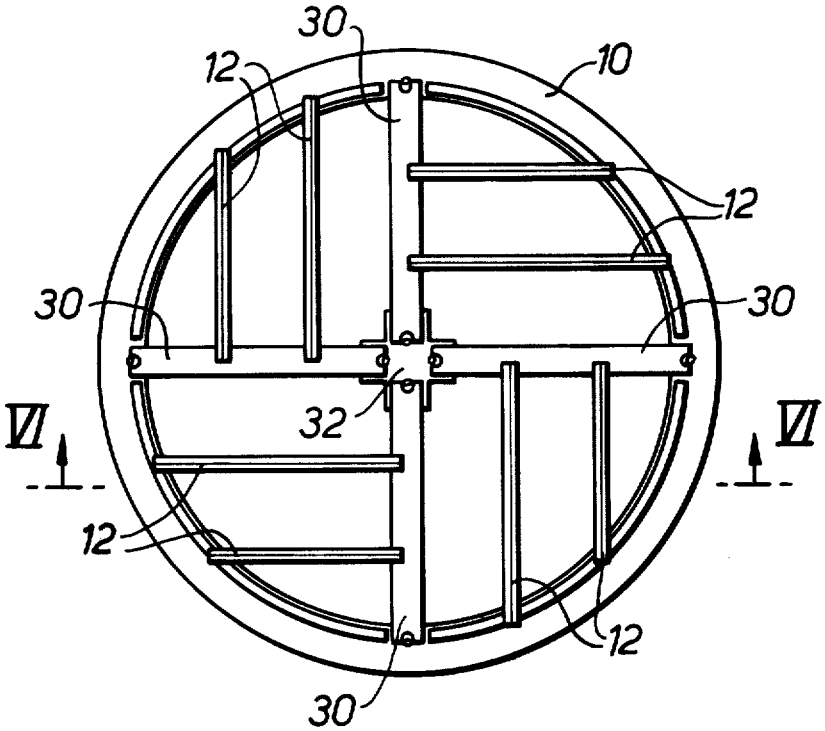
FIG. 5 is a diagrammatic plan view of an alternative embodiment of rotary heat exchanger (with its heat storage blocks omitted) and FIG. 6 is a side cross-sectional view on the line VI—VI of FIG. 5 (with heat storage blocks included).
Figure 6:
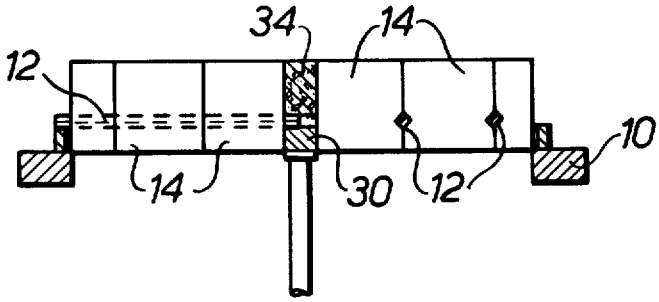

However, for large diameter matrices mechanical strength limitations require the use of auxiliary support beams to reduce the unsupported span length of the simple parallel grid system. In such an arrangement as illustrated in FIGS. 5 and 6, the matrix is divided into quadrants by rectangular beams 30 which are simply supported and located circumferentially on the frame member or rim 10 and on a central hub support 32. Each quadrant is provided with a ceramic block/parallel bar grid sub-assembly 14-12 which sub-assembly is supported on a beam 30 and on the rim 10. As in the previous embodiment the overall assembly of blocks 14 may be compacted by an appropriate radially acting compression system. The positioning of the grooves 18 in the ceramic blocks 14 is such that the lower faces or blocks are flush with the lower faces of the support beams 30 and so form a continuous profile at the lower "cold" end of the matrix. At the upper end of the matrix blank ceramic blocks 34 are fitted over the support beams 30 to produce a flat upper face profile.

We claim:

1. A heat exchanger of the regenerative type for transfering heat from a hot gas to a cooler gas, said heat exchanger comprising: a matrix of heat storage elements having an under face for exposure to the cooler gas and an upper face for exposure to the hot gas, each element of the matrix comprising a ceramic heat storage block having a plurality of gas flow passages extending therethrough from end to end in the block; and a support structure including support bars and a frame member surrounding the matrix, the support bars passing through the matrix adjacent to, but behind, the under face of the matrix which in use is exposed to the cooler gas, said support bars being in turn supported by the frame member surrounding the matrix, the arrangement being such that in use the bars of the support structure are protected from damage by the hot gas which is supplied to the matrix.

2. A heat exchanger as claimed in claim 1, wherein the frame member is a circular rim, wherein the matrix has a cylindrical configuration, and wherein the rim is driven to rotate by a gear drive meshed with the periphery of the rim.

3. A heat exchanger as claimed in claim 1 in which at least some of the heat storage blocks are of substantially right-angled parallelopipedal form having an external groove adjacent one end for cooperation with one or more of the support bars.

4. A heat exchanger as claimed in claim 1 in which those blocks adjacent to the frame member have surfaces which are shaped to correspond to the frame member and with one or more of the support bars.

5. A heat exchanger as claimed in claim 1 wherein there are blocks spaced from the frame member and blocks engaged by the frame member wherein those blocks spaced from the frame member have two external grooves, one in each of two opposite sides of the block, for cooperation with two respective support bars.

6. A heat exchanger as claimed in claim 1 further including means for urging the heat storage blocks into firm abutting contact with one another by using biasing means acting inwardly on the blocks at the periphery of the matrix.

7. A heat exchanger as claimed in claim 6 in which the biasing means comprises a plurality of spaced fluid pressure actuated rams.

8. A heat exchanger as claimed in claim 6 in which the biasing means comprises resilient packing means located around the peripheral blocks of the matrix.

9. A heat exchanger as claimed in claim 8 further including mechanical means for compressing the resilient packing.

10. A heat exchanger of the regenerative type for transfering heat from a stream of hot gas to a stream of cooler gas, the heat exchanger comprising: a matrix, said matrix being made of ceramic heat storage blocks and having ceramic hot and cooler faces; each block having a plurality of gas flow passages extending therethrough from end to end, wherein some of the blocks are interior blocks having flat rectangular sides and others of the blocks are exterior blocks having rectangular sides and an arcuate side, which arcuate side cooperates with arcuate sides of other blocks to form a circle when the blocks are arranged with the interior blocks surrounded by the exterior blocks and the arcuate sides arranged in juxtaposition; grooves in the sides of the blocks, the grooves being closer to the cooler face of the matrix than the hot face; support rods extending between the blocks and within the grooves of adjacent blocks to retain the blocks in fixed relation to one another; rim means surrounding the matrix and supporting the rods, and means for driving the rim means to rotate the heat exchanger so that the heat exchanger passes alternately through the stream of hot gas and the stream of cooler gas.

11. The heat exchanger of claim 10 wherein the matrix is oriented with the rim in a horizontal plane, with the support rods resting thereupon and the hot and cooler faces in horizontal planes with the streams impinging vertically thereupon.

12. The heat exchanger of claim 11 further including means disposed about the periphery of the matrix for urging the rectangular surfaces of the blocks of the matrix into abutment with one another.

* * * * *